US007559880B1

(12) United States Patent
Calhoun

(10) Patent No.: US 7,559,880 B1
(45) Date of Patent: Jul. 14, 2009

(54) MARTIAL ARTS ACCESSORY APPARATUS

(76) Inventor: Marvin P. Calhoun, 1823 Walgrove Ave., Los Angeles, CA (US) 90066

( * ) Notice: Subject to any disclaimer, the term of this patent is extended or adjusted under 35 U.S.C. 154(b) by 12 days.

(21) Appl. No.: 11/955,445

(22) Filed: Dec. 13, 2007

(51) Int. Cl.
*A63B 69/34* (2006.01)

(52) U.S. Cl. ..... 482/83; 482/85; 482/87; 482/90

(58) Field of Classification Search ..... 482/83–87, 482/89–90; 273/440.1; 473/441, 443; 434/247
See application file for complete search history.

(56) References Cited

U.S. PATENT DOCUMENTS

| | | | | |
|---|---|---|---|---|
| 4,491,316 | A * | 1/1985 | Prince | 482/90 |
| 4,572,504 | A | 2/1986 | DiBartolo | |
| 4,757,989 | A * | 7/1988 | Bauer, Jr. | 482/83 |
| 4,889,334 | A | 12/1989 | Partlo | |
| 4,973,045 | A | 11/1990 | Heberer | |
| 5,458,551 | A * | 10/1995 | Shenton | 482/83 |
| 5,665,035 | A * | 9/1997 | Tumminia | 482/83 |
| 5,863,279 | A | 1/1999 | Pouliot | |
| D424,648 | S | 5/2000 | Ennis et al. | |
| 6,149,553 | A | 11/2000 | Antoszewski | |
| 6,217,490 | B1 | 4/2001 | Wurtak | |
| 7,377,883 | B1 * | 5/2008 | Blanton | 482/90 |

* cited by examiner

*Primary Examiner*—Fenn C Mathew
*Assistant Examiner*—Andrew M Tecco
(74) *Attorney, Agent, or Firm*—Crossley Patent Law; Mark A. Crossley

(57) ABSTRACT

The martial arts accessory apparatus provides a sturdy backdrop for target attachments. The slideably fitted inserts fit in a plurality of positions within the sleeves. Additionally, the cross brace provides slideable fit of the target structure verticals, thereby providing target height adjustment. The first target structure provides for holding objects to be struck, such as boards or bricks, in a choice of pivoted positions, the first target structure fittable to the horizontal in a plurality of rotated positions, thereby providing for a user to ideally position the object to be struck. The first target structure provides a significant gap between arms so that impact follow through may be practiced without injury to the user. The variety of target structures and positioning capabilities allow a user to optimally locate each target or object to be struck so that a variety of striking positions and striking body parts can be used.

19 Claims, 5 Drawing Sheets

MARTIAL ARTS ACCESSORY APPARATUS

BACKGROUND OF THE INVENTION

It is common in martial arts to practice and demonstrate the breaking of objects such as boards, cement blocks, bricks, and the like. Objects are broken by strikes, blows, and kicks. Many body parts can be used, such as fists, elbows, head, knees, and feet. Typically, objects are held by an assistant. Considerable time and often skill is required to correctly hold objects so that they are not only capable of breakage, but so the neither the demonstrating party nor the holder is injured. To eliminate the need for a holder, devices have been proposed which hold objects for the demonstrator. A host of problems exist with such devices. As example, some must be attached to a wall and are often limited to a height or a limited height range. Other devices provide a means for holding a board, but not other objects. And, some such devices often pose a threat to the demonstrator due to the likelihood of part of the device being struck by the demonstrator.

Some devices provide height adjustment but in so doing cause the held object to be at an undesirable angle. Some devices solve these problems but do not provide for pivotal adjustment of the object in more than one plane. Still other devices are troublesome in use, requiring too much time or trouble to fix the object in preparation of striking. Further, other devices simply are not sturdy enough to prevent movement, thereby decreasing the chance of objects being broken. The present apparatus solves these problems.

FIELD OF THE INVENTION

The martial arts accessory apparatus relates to martial arts practices and demonstrations and more especially to an apparatus for holding a variety of target objects for striking.

SUMMARY OF THE INVENTION

The general purpose of the martial arts accessory apparatus, described subsequently in greater detail, is to provide a martial arts accessory apparatus which has many novel features that result in an improved martial arts accessory apparatus which is not anticipated, rendered obvious, suggested, or even implied by prior art, either alone or in combination thereof.

To attain this, the martial arts accessory apparatus provides a sturdy backdrop for target attachments so that movement of the apparatus upon striking a target is resisted. The slideably fitted inserts fit in a plurality of positions within the sleeves. Additionally, the cross brace provides slideable fit of the target structure verticals, thereby providing target height adjustment. The first target structure also provides for holding an object or objects to be struck, such as boards or bricks, in a choice of pivoted positions. And, the first target structure can be fitted to the horizontal in a plurality of rotated positions, thereby providing for a user to ideally position the object to be struck so that maximal impact forces may be exerted. Further, the first target structure provides a significant gap between arms so that impact follow through may be practiced without injury to the user. Other target structures provide target variation. The variety of target structures and positioning capabilities allow a user to optimally locate each target or object to be struck so that a variety of striking positions and striking body parts can be used, at desired angle and position to the user.

Thus has been broadly outlined the more important features of the improved martial arts accessory apparatus so that the detailed description thereof that follows may be better understood and in order that the present contribution to the art may be better appreciated.

An object of the martial arts accessory apparatus is to be sturdy.

Another object of the martial arts accessory apparatus is to provide a plurality of target structures for striking by a user.

A further object of the martial arts accessory apparatus is to provide sufficient mass to avoid movement when struck.

An added object of the martial arts accessory apparatus is to provide height adjustment of the target.

And, an object of the martial arts accessory apparatus is to provide pivotal adjustment of the target.

Still another object of the martial arts accessory apparatus is to provide rotational positioning options in target placement.

Yet another object of the martial arts accessory apparatus is it to guard against user injury.

These together with additional objects, features and advantages of the improved martial arts accessory apparatus will be readily apparent to those of ordinary skill in the art upon reading the following detailed description of presently preferred, but nonetheless illustrative, embodiments of the improved martial arts accessory apparatus when taken in conjunction with the accompanying drawings.

In this respect, before explaining the current embodiments of the improved martial arts accessory apparatus in detail, it is to be understood that the martial arts accessory apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved martial arts accessory apparatus.

It is therefore important that the claims be regarded as including such equivalent constructions insofar as they do not depart from the spirit and scope of the martial arts accessory apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 6 thereof, the principles and concepts of the martial arts accessory apparatus generally designated by the reference number 10 will be described.

Figure 1:
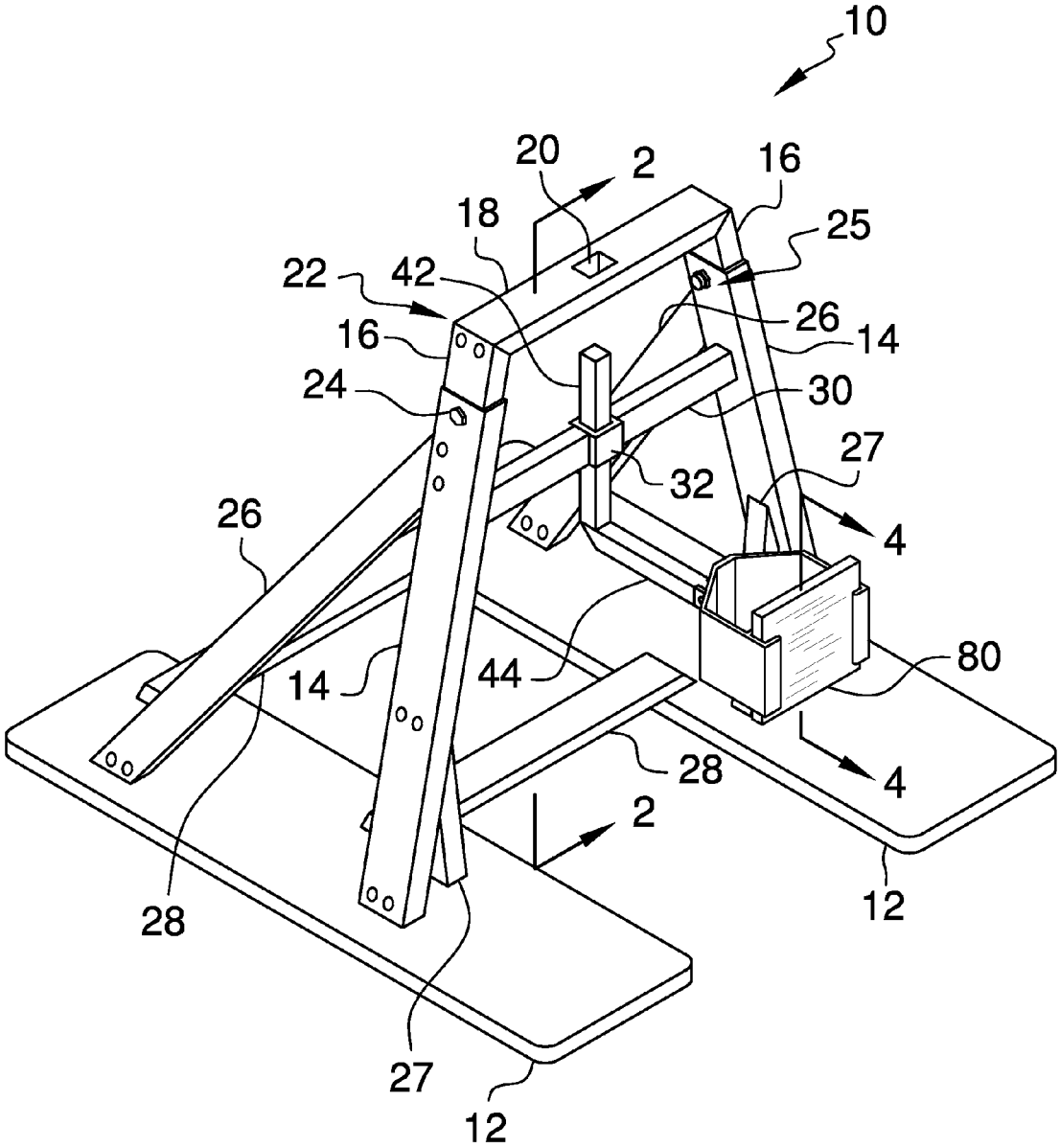
FIG. 1 is a perspective view with target structure A attached.
Figure 2:
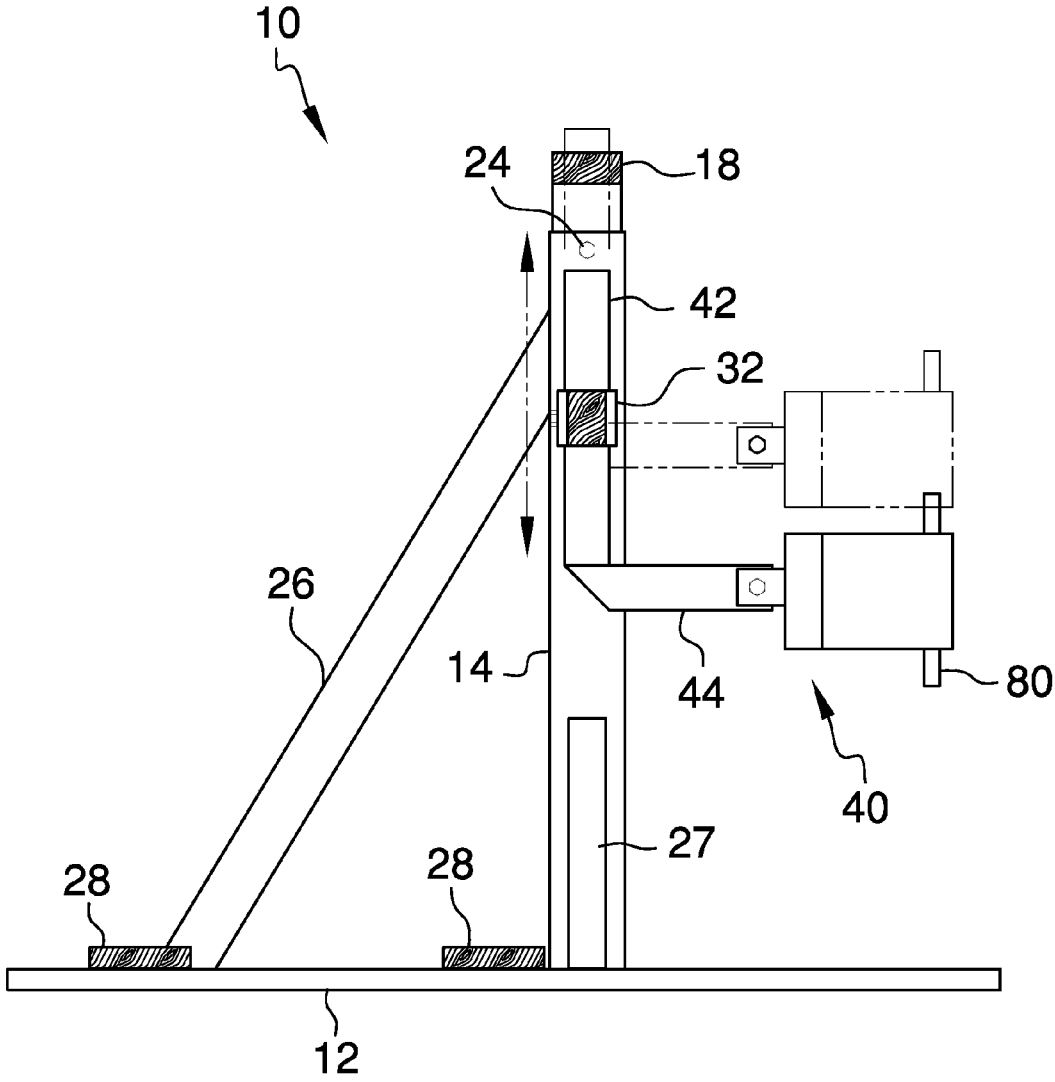
FIG. 2 is a cross sectional lateral view with target structure A attached.
Figure 5:
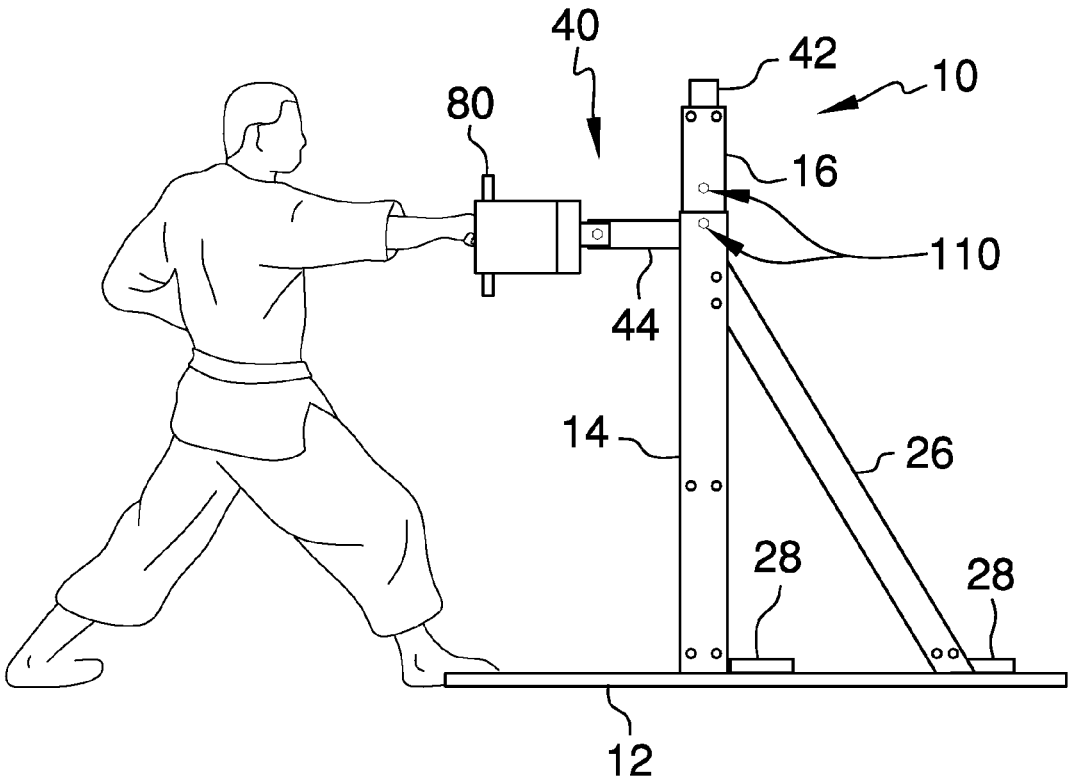
FIG. 5 is a lateral elevation of the apparatus in use, with target structure A.

Referring to FIGS. 1, 2, and 5, the martial arts accessory apparatus 10 is provided for holding a variety of objects 80 to be struck. The apparatus 10 comprises a pair of hollow rectangular spaced apart bases 12. The bases 12 are also provided in a solid form, in another embodiment. Each hollow base 12 capable of holding a pourable material such as sand or water, in order that each base 12. thereby provides additional mass. Added mass prevents the apparatus 10 from moving. Added mass also provides a more massive target holding apparatus 10 which aids the user in breaking various objects 80 which the apparatus 10 selectively holds. Two perpendicularly disposed lateral ties 28 connect the bases 12. An upright sleeve 14 angularly and inwardly projects upwardly from each base 12. An angle support 26 angularly connects an upper back side of each upright sleeve 14 to one of each of the bases 12, proximal to a rear of each base 12. A lower angle support 27 connects the lower inner side of each upright sleeve 14 to one of each of the bases 12. The cross brace 30 connects and supports the upright sleeves 14. A pair of opposed pin orifices 25 is proximal to the top of each upright sleeve 14. An upright insert 16 slideably inserts into the top of each upright sleeve 14. A plurality of spaced apart opposed pairs of openings 110 is disposed in each insert 16. The openings 110 selectively align with the pin orifices 25 in each upright sleeve 14. By raising or lowering the inserts 16, then inserting the removable lock pins 24 into the sleeve openings and the pin orifices 25, the height of the inserts 16 and cross bar 18 are adjusted. The cross bar 18 joins the top of each insert 16. The cross bar 18 has a flex joint 22 at each upright sleeve 14 so that the slanted inserts 16 are able to slide within the slanted upright sleeves 14. The rectangular cross bar opening 20 is disposed in the center of the cross bar 18 in order to provide for clearance of the vertical 42 as needed.

Figure 3:
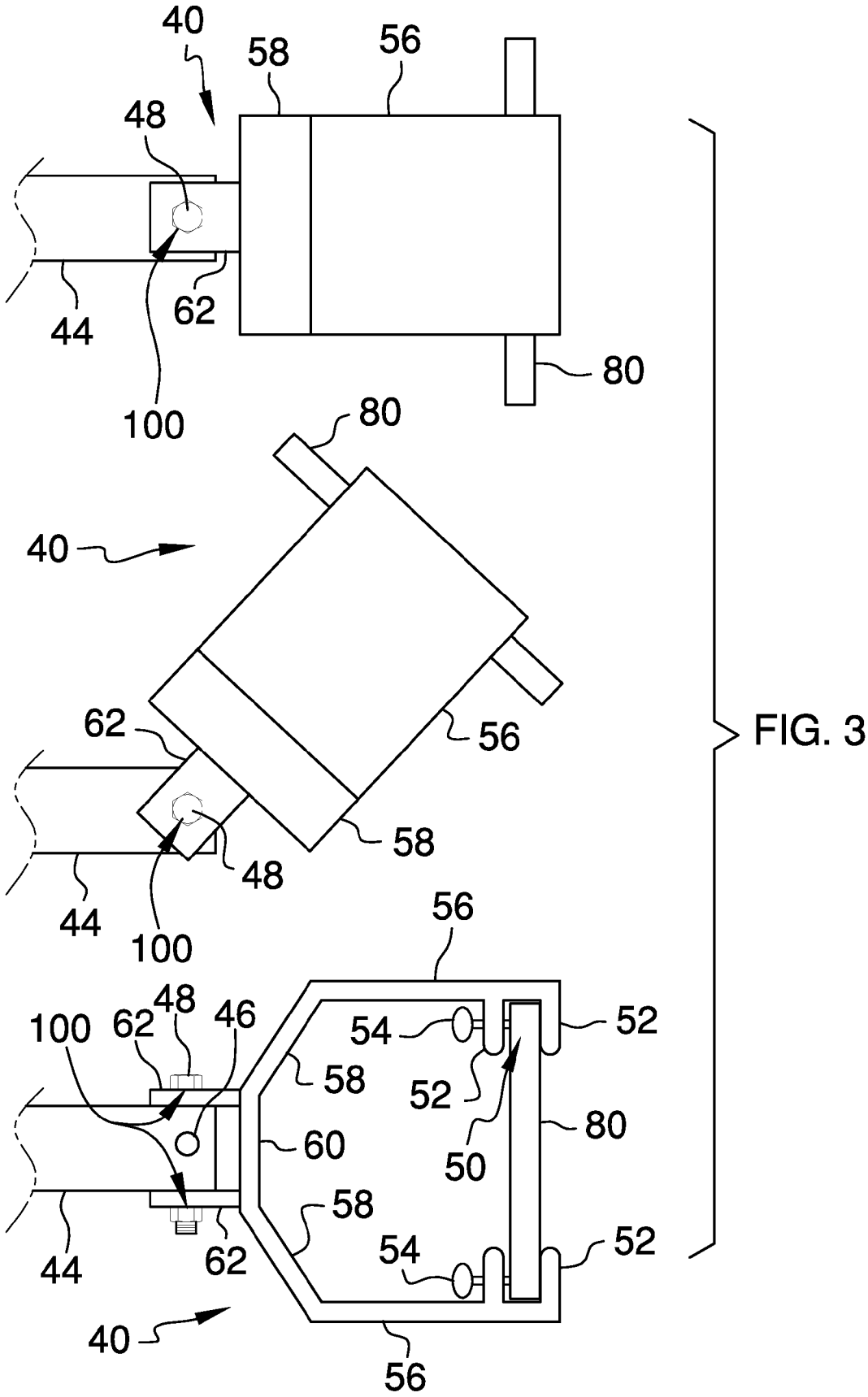
FIG. 3 is a plurality of elevation views of target structure A, illustrating pivotal and varied mounts of the ears to the horizontal.
Figure 4:
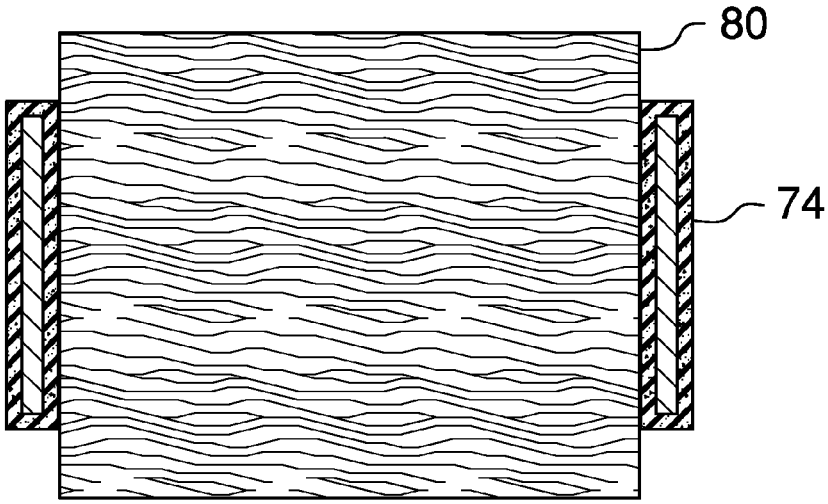
FIG. 4 is partial cross sectional view of the arms of target structure A, with an object to be struck.
Figure 6:
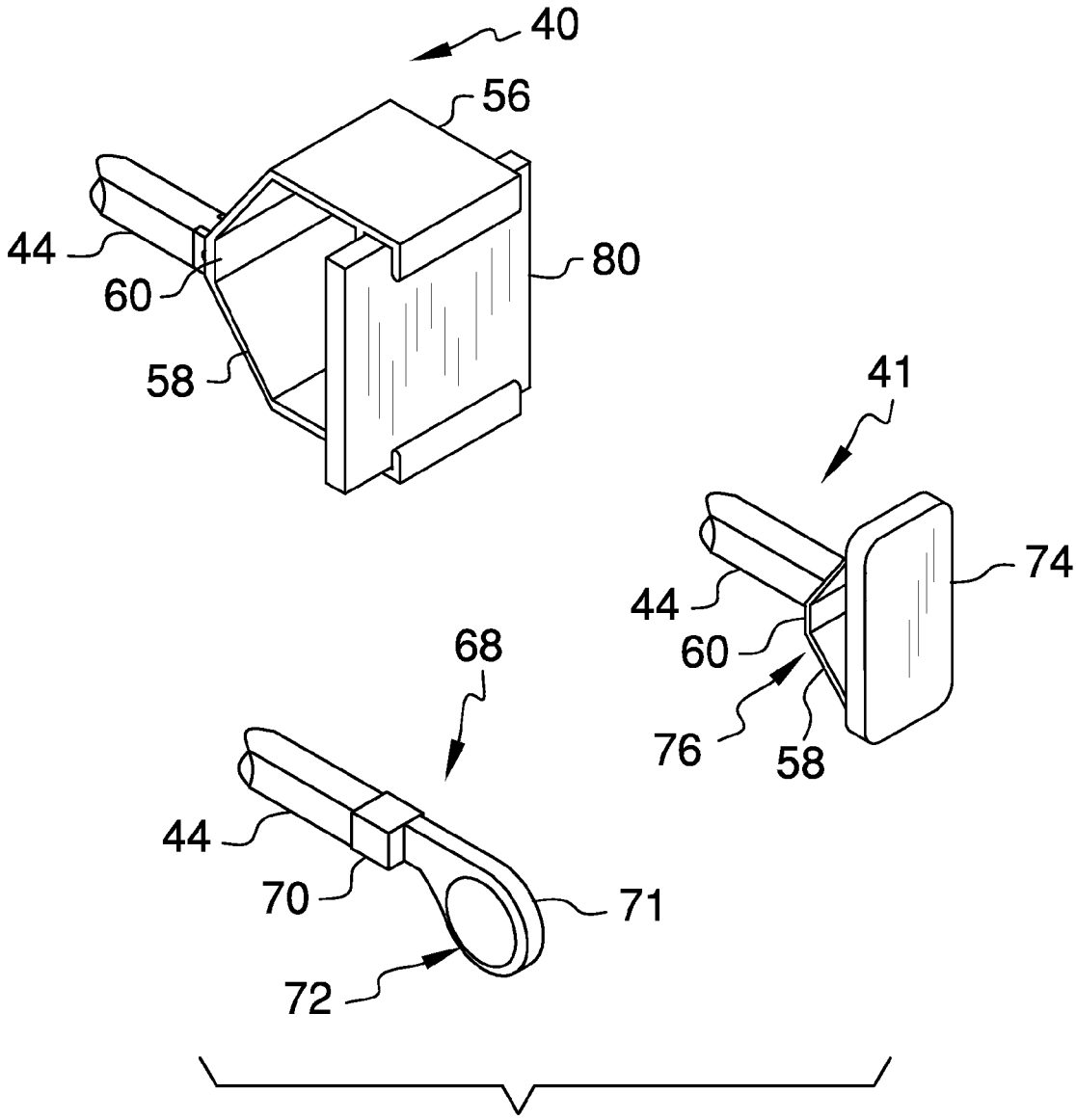
FIG. 6 is a plurality of perspective views of the various target structures of the apparatus.

Referring to FIGS. 3, 4, and 6, the target structure A 40 is provided for fit within the cross brace channel 32. The target structure A 40 comprises a rectangular vertical 42 for selectively securable slideable fit within the cross brace channel 32. A locking pin (not shown) or wing bolt (not shown) insert through the rear of the cross brace channel 32 and into the vertical 42. Such fasteners are common in the mechanical arts. The rectangular horizontal 44 extends from the vertical 42. A structure orifice 46 is disposed in each of the four sides of the outer end of the horizontal 44. A pair of spaced apart ears 62 is connected to the central member 60. Each ear 62 has an ear structure orifice 100 for selective attachment to the rectangular horizontal 44 via a structure retainer 48. The pair of spaced apart transverses 58 is connected to each end of the central member 60. An arm 56 is connected to each transverse 58. Each arm 56 is parallel to the horizontal 44. A slot 50 is disposed at the outer end of each arm 56. Each slot 50 is for removable receipt of variety of objects 80 to be struck. The slots 50 and arms 56 are optionally fitted with padding 74 to prevent user injury. A target retainer 54 selectively secures the objects 80 to be struck within the slots 50. By providing structure orifices 46 in each side of the horizontal 44, the target structure A 40 can be positioned in 90 degree increments, as desired. An additional target structure B 41 is provided. Target structure B 41 comprises a rectangular vertical 42 for selectively securable slideable fit within the cross brace channel 32. The rectangular horizontal 44 extends from the vertical 42.

The central member 60 is attached to the rectangular horizontal 44. The pair of spaced apart transverses 58 is connected to each end of the central member 60. The rectangular elastomeric pad 74 is attached to the transverses 58. The third target structure C 68 is provided for selective fit to the outer end of the rectangular horizontal 44 used with the first target structure A 40. The third target structure C 68 comprises a rectangular sleeve 70 for selective fit to the outer end of the rectangular horizontal 44. The third target structure C 68 is interference fitted to the horizontal 44 after the structure retainer 48 is removed. The extension 71 is attached to the rectangular sleeve 70. The extension 71 has a rounded outer end. The round target 72 is attached to the rounded outer end of the extension 71. The round target 72 is made of elastomeric material.

With respect to the above description then, it is to be realized that the optimum dimensional relationships for the parts of the martial arts accessory apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the martial arts accessory apparatus.

Directional terms such as "front", "back", "in", "out", "downward", "upper", "lower", and the like may have been used in the description. These terms are applicable to the embodiments shown and described in conjunction with the drawings.

These terms are merely used for the purpose of description in connection with the drawings and do not necessarily apply to the position in which the martial arts accessory apparatus may be used.

Therefore, the foregoing is considered as illustrative only of the principles of the martial arts accessory apparatus. Further, since numerous modifications and changes will readily occur to those skilled in the art, it is not desired to limit the martial arts accessory apparatus to the exact construction and operation shown and described, and accordingly, all suitable modifications and equivalents may be resorted to, falling within the scope of the martial arts accessory apparatus.

What is claimed is:

1. A martial arts accessory apparatus for holding an object to be struck, the apparatus comprising:

a pair rectangular spaced apart bases;

a perpendicularly disposed lateral tie connecting the bases;

an upright sleeve projected upwardly from each base;

an angle support angularly connecting an upper back side of each upright sleeve to one of each of the bases;

a cross brace connecting and supporting the upright sleeves;

a rectangular cross brace channel within a center of the cross brace;

a pair of opposed pin orifices proximal to a top of each upright sleeve;

an upright insert slideably inserted into the top of each upright sleeve;

a plurality of spaced apart opposed pairs of sleeve openings in each insert, the sleeve openings selectively aligning with the pin orifices in each upright sleeve;

lock pins for removable insertion into the sleeve openings and pin orifices;

a cross bar joining a top of each insert;

a rectangular cross bar opening in a center of the cross bar;

a target structure that fits within the cross brace channel, the target structure comprising:

a rectangular vertical member which is adapted for a selectively securable slideable fit within the cross brace channel;

a rectangular horizontal member extended from the vertical member, a structure orifice on each side of an outer end of the horizontal member;

a pair of spaced apart ears connected to a central member, each ear having an ear structure orifice for selective attachment to the rectangular horizontal member;

a pair of spaced apart transverse members each connected to a respective end of the central member;

an arm connected to each transverse member, each arm parallel to the horizontal member;

a slot at an outer end of each arm, the slot adapted for removable receipt of the object to be struck; and means for selectively securing the object to be struck within the slot.

2. The apparatus according to claim 1 further comprising more than one perpendicularly disposed lateral tie connecting the bases.

3. The apparatus according to claim 1 further comprising a lower angle support connecting a lower inner side of each upright sleeve to one of each of the bases.

4. The apparatus according to claim 2 further comprising a lower angle support connecting a lower inner side of each upright sleeve to one of each of the bases.

5. The apparatus according to claim 1 wherein the slot further comprises the capability of holding more than one object to be struck; and the means for selectively securing the objects to be struck further comprises adjustability for securing the objects.

6. The apparatus according to claim 2 wherein the slot further comprises the capability of holding more than one object to be struck; and the means for selectively securing the objects to be struck further comprises adjustability for securing the objects.

7. The apparatus according to claim 3 wherein the slot further comprises the capability of holding more than one object to be struck; and the means for selectively securing the objects to be struck further comprises adjustability for securing the objects.

8. The apparatus according to claim 4 wherein the slot further comprises the capability of holding more than one object to be struck; and the means for selectively securing the objects to be struck further comprises adjustability for securing the objects.

9. A martial arts accessory apparatus for holding a plurality of objects to be struck, the apparatus comprising:

a pair rectangular spaced apart bases;

a perpendicularly disposed lateral tie connecting the bases;

an upright sleeve angularly and inwardly projected upwardly from each base;

an angle support angularly connecting an upper back side of each upright sleeve to one of each of the bases;

a cross brace connecting and supporting the upright sleeves;

a rectangular cross brace channel in a center of the cross brace;

a pair of opposed pin orifices proximal to a top of each upright sleeve;

an upright insert slideably inserted into the top of each upright sleeve;

a plurality of spaced apart opposed pairs of sleeve openings in each insert, the sleeve openings selectively aligning with the pin orifices in each upright sleeve;

lock pins for removable insertion into the sleeve openings and pin orifices;

a cross bar joining a top of each insert, the cross bar having a flex joint at each upright sleeve;

a rectangular cross bar opening in a center of the cross bar; and a target structure that fits within the cross brace channel, the target structure comprising:

a rectangular vertical member which is adapted for a selectively securable slideable fit within the cross brace channel;

a rectangular horizontal member extended from the vertical member, a structure orifice on each side of an outer end of the horizontal member;

a pair of spaced apart ears connected to a central member, each ear having an ear structure orifice for selective attachment to the rectangular horizontal member;

a pair of spaced apart transverse members each connected to a respective end of the central member;

an arm connected to each transverse member, each arm parallel to the horizontal member;

a slot at an outer end of each arm, the slot adapted for removable receipt of one or more of the plurality of objects to be struck; and means for selectively securing the object to be struck within the slot.

10. The apparatus according to claim 9 further comprising a second target structure, comprising:

a second target rectangular vertical member for a selectively securable slideable fit within the cross brace channel;

a second target rectangular horizontal member extended from the second target vertical member;

a second target central member attached to the second target rectangular horizontal member;

a second target pair of spaced apart transverse members each connected to a respective end of the second target central member; and a rectangular elastomeric pad attached to the second target transverse members.

11. The apparatus according to claim 9 further comprising a second target structure for a selective fit to the outer end of the rectangular horizontal member.

12. The apparatus according to claim 10 further comprising a third target structure for a selective fit to the outer end of the rectangular horizontal member.

13. The apparatus according to claim 11 wherein the third target structure further comprises a horizontal sleeve for a selective fit to the outer end of the rectangular horizontal member.

14. The apparatus according to claim 12 wherein the third target structure further comprises a horizontal sleeve for selective fit to the outer end of the rectangular horizontal member.

15. The apparatus according to claim 11 wherein the second target structure further comprises a rectangular sleeve for a selective fit to the outer end of the rectangular horizontal member;

an extension attached to the rectangular sleeve, the extension having a rounded outer end; and a round target attached to the rounded outer end of the extension.

16. The apparatus according to claim 12 wherein the third target structure further comprises a rectangular sleeve for a selective fit to the outer end of the rectangular horizontal member;

an extension attached to the rectangular sleeve, the extension having a rounded outer end; and a round target attached to the rounded outer end of the extension.

17. The apparatus according to claim 15 wherein the rounded outer end further comprises an elastomeric material.

18. The apparatus according to claim 16 wherein the rounded outer end further comprises an elastomeric material.

19. A martial arts accessory apparatus for holding a variety of objects to be struck, the apparatus comprising:

a pair of hollow rectangular spaced apart bases, each base capable of holding a pourable material;

at least one perpendicularly disposed lateral tie connecting the bases;

an upright sleeve projected upwardly from each base;

an angle support angularly connecting an upper back side of each upright sleeve to one of each of the bases;

a lower angle support connecting a lower inner side of each upright sleeve to one of each of the bases;

a cross brace connecting and supporting the upright sleeves;

a cross brace channel within a center of the cross brace;

a pair of opposed pin orifices proximal to a top of each upright sleeve;

an upright insert slideably inserted into the top of each upright sleeve;

a plurality of spaced apart opposed pairs of sleeve openings in each insert, the sleeve openings selectively aligning with the pin orifices in each upright sleeve;

lock pins for removable insertion into the sleeve openings and pin orifices;

a cross bar joining a top of each insert, the cross bar having a flex joint at each upright sleeve;

a rectangular cross bar opening in a center of the cross bar;

a target structure that fits within the cross brace channel, the target structure comprising:

a rectangular vertical member which is adapted for a selectively securable slideable fit within the cross brace channel;

a rectangular horizontal member extended from the vertical member, a structure orifice on each side of an outer end of the horizontal member;

a pair of spaced apart ears connected to a central member, each ear having an ear structure orifice for selective attachment to the rectangular horizontal member;

a pair of spaced apart transverse members each connected to a respective end of the central member;

an arm connected to each transverse member, each arm parallel to the horizontal member;

a slot at an outer end of each arm, the slot adapted for removable receipt of the variety of objects to be struck;

means for selectively securing the objects to be struck within the slot;

a second target structure, comprising:

a second target rectangular vertical member for a selectively securable slideable fit within the cross brace channel;

a second target rectangular horizontal member extended from the second target vertical member;

a second target central member attached to the second target rectangular horizontal member;

a second target pair of spaced apart transverse members each connected to a respective end of the central member; and a rectangular elastomeric pad attached to the second target transverse members;

a third target structure for a selective fit to the outer end of the rectangular horizontal, comprising:

a rectangular sleeve for a selective fit to the outer end of the rectangular horizontal member;

an extension attached to the rectangular sleeve, the extension having a rounded outer end; and a round target attached to the rounded outer end of the extension.

* * * * *